US005307557A

United States Patent [19]

Te-Hsueh

[11] Patent Number: 5,307,557

[45] Date of Patent: May 3, 1994

[54] METHOD OF MANUFACTURING A CHIP INDUCTOR WITH CERAMIC ENCLOSURE

[75] Inventor: Iseng Te-Hsueh, Hsin-Chu Hsien, Taiwan

[73] Assignee: Chilisin Electronics Corporation, Taiwan

[21] Appl. No.: 868,540

[22] Filed: Apr. 14, 1992

[51] Int. Cl.[5] ..... H01F 41/02

[52] U.S. Cl. ..... 29/605; 29/602.1; 336/83; 336/96; 336/192

[58] Field of Search ..... 29/605, 606, 602.1; 336/83, 96, 192

[56] References Cited

U.S. PATENT DOCUMENTS 4,706,058 11/1987 Barbier et al. ..... 29/606 X

*Primary Examiner*—Carl E. Hall

*Attorney, Agent, or Firm*—Poms, Smith, Lande & Rose

[57] ABSTRACT

A chip inductor is provided and a ceramic enclosure is formed with a central bore therein by means of known powder metallurgy techniques. The ceramic powders are bonded with a suitable bonder, such as polyvinyl alcohol (PVA), to form particles of a suitable size. The particles are then compacted and pressed by, for example, a hydraulic device to form a desired shape and then sintered and 1,300 to 1,500 degrees Celsius. Thereafter, terminals for external connection, which has three layers of different metals and/or alloys, such as silver, nickel and the alloy of tin and lead, are formed on suitable locations of the ceramic enclosure. The naked chip inductor is disposed inside the central bore of the ceramic enclosure and soldered to the pre-formed terminals. The final phase of the manufacturing process is to seal the openings of the central bore of the ceramic enclosure with resin, such as epoxy resin or acrylic resin.

A ceramic chip inductor is formed with a ceramic shield and since no high temperature process is involved, the physic property of the chip inductor is maintained constant during the manufacturing process.

8 Claims, 2 Drawing Sheets

METHOD OF MANUFACTURING A CHIP INDUCTOR WITH CERAMIC ENCLOSURE

FIELD OF THE INVENTION

The present invention relates generally to a chip inductor and in particular to one having ceramic enclosure and the method for manufacturing the ceramic enclosed chip inductor.

BACKGROUND OF THE INVENTION

Conventionally, chip inductors are either produced without an insulating jacket or enclosed with an epoxy resin shield. The disadvantage of the shieldless or naked chip inductors is evident and the epoxy enclosed chip inductor (which will be also referred to as the epoxy chip inductor hereinafter) is to overcome the disadvantage of shieldlessness. The manufacture process of the epoxy chip inductor is first to make a naked chip inductor by winding wires on a core of magnetic material and then soldering metal terminals to the wire. The portion of the metal terminals in the proximity of the soldering connections are then struck flat to form a desirable terminal shape and thereafter the naked inductor is covered completely with the epoxy material, except the flat terminals, by means of the modeling injection technique, which in some respects is a high temperature process, epoxy being serving as an insulation shield for the chip inductor, but the manufacturing process for the epoxy chip inductor and the epoxy chip inductor itself have several disadvantages:

(1) the epoxy material should be kept in a low temperature and thus difficult to handle in storage;

(2) the naked chip inductor, particularly the wound wire thereof, is easy to be damaged during modeling injection;

(3) it takes time to harden the epoxy material;

(4) workers have to work in a high temperature environments;

(5) the manufacture process is very long and thus reducing the manufacturing efficiency;

(6) the metal terminals are easy to be oxidized in the high temperature injection process and the soldering connection may be damaged in the high temperature environments due to the melting of the solder; and (7) the variation of the injection pressure usually results in a variation in the finished epoxy chip inductors and sometime breaking the terminals and thus deteriorating the product quality as a result.

OBJECTS OF THE INVENTION

It is therefore an object of the present invention to provide a chip inductor with a ceramic enclosure (also referred to as a ceramic chip inductor hereinafter) of which the insulation property is significantly upgraded as compared with the epoxy shield.

It is another object of the present invention to provide a ceramic chip inductor which the induction property varies only slightly during the manufacturing process.

It is a further object of the present invention to provide a ceramic chip inductor manufacturing process which has no above-mentioned drawbacks of the prior art manufacturing process.

It is a further object of the present invention to provide a ceramic chip inductor manufacturing process which provides chip inductors of many shapes, such as a rectangular or cylindrical one.

It is a further object of the present invention to provide a ceramic chip inductor manufacturing process which provides chip inductors with a smooth surface and better quality of soldering in the terminals thereof and thus suitable for automation mass production.

It is a further object of the present invention to provide a ceramic chip inductor manufacturing process which provide chip inductors having a good reliability and the physical property thereof can be maintained substantially stable during the manufacturing process.

To achieve the object, a naked chip inductor is manufactured with the conventional procedure and the ceramic enclosure is formed with a central bore therein by means of the known powder metallurgy techniques. The ceramic powders are bonded with a suitable bonder, such as polyvinyl alcohol (PVA), to form particles of a suitable size. The particles are then compacted and pressed by, for example, a hydraulic device to form a desired shape and then sintered at 1,300 to 1,500 degrees Celsius. Thereafter, terminals for external connection, which has three layers of different metals and/or alloys, such as silver, nickel and the alloy of tin and lead, are formed on suitable locations of the ceramic enclosure. The naked chip inductor is disposed inside the central bore of the ceramic enclosure and soldered to the pre-formed terminals. The final phase of the manufacturing process is to seal the openings of the central bore of the ceramic enclosure with resin, such as epoxy resin or acrylic resin. A ceramic chip inductor is formed with a ceramic shield and since no high temperature process is involved, the physic property of the chip inductor is maintained constant during the manufacturing process.

Other objects and advantages of the invention will be apparent from the following description of the preferred embodiment taken in connection with the accompanying drawings wherein:

DETAILED DESCRIPTION OF THE PREFERRED EMBODIMENT

Figure 1:
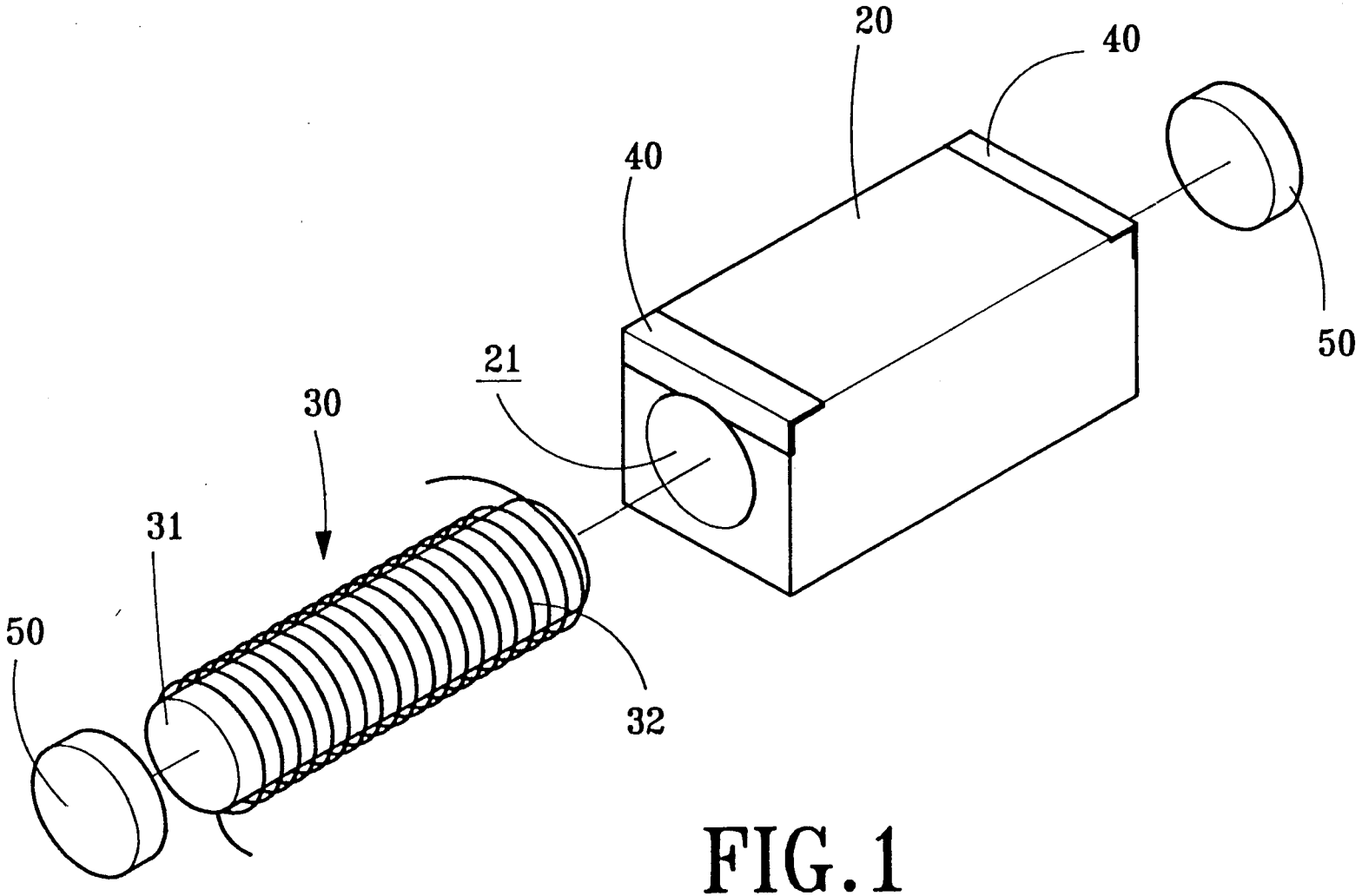
FIG. 1 is an exploded perspective view of the ceramic chip inductor in accordance with the invention.

With reference to the drawings, and in particular to FIG. 1, a ceramic chip inductor in accordance with the present invention, generally designated with the reference numeral 10, comprises a parallelepiped ceramic enclosure 20, preferably made of kaoline with a major contents of aluminum oxide ($Al_2O_3$), having a central bore 21 inside which a naked chip inductor 30 formed with a core of magnetic material 31 wound with an electrical wire 32 is disposed. It should be noted that the parallelepiped enclosure is only an example herein and other shapes can be adapted. External terminals 40, which is made of a plurality layers of different metals and/or alloys thereof, such as one layer of silver, one layer of nickel and one layer of the alloy of tin and lead, are formed at suitable locations of the ceramic enclosure 20. The external terminals 40 are soldered to the wire 32 of the naked chip inductor 30 to form electrical connections therebetween. Insulating fillers 50, preferably made of resin, such as epoxy resin or acrylic resin, are then used to seal the central bore 21.

Figure 2:
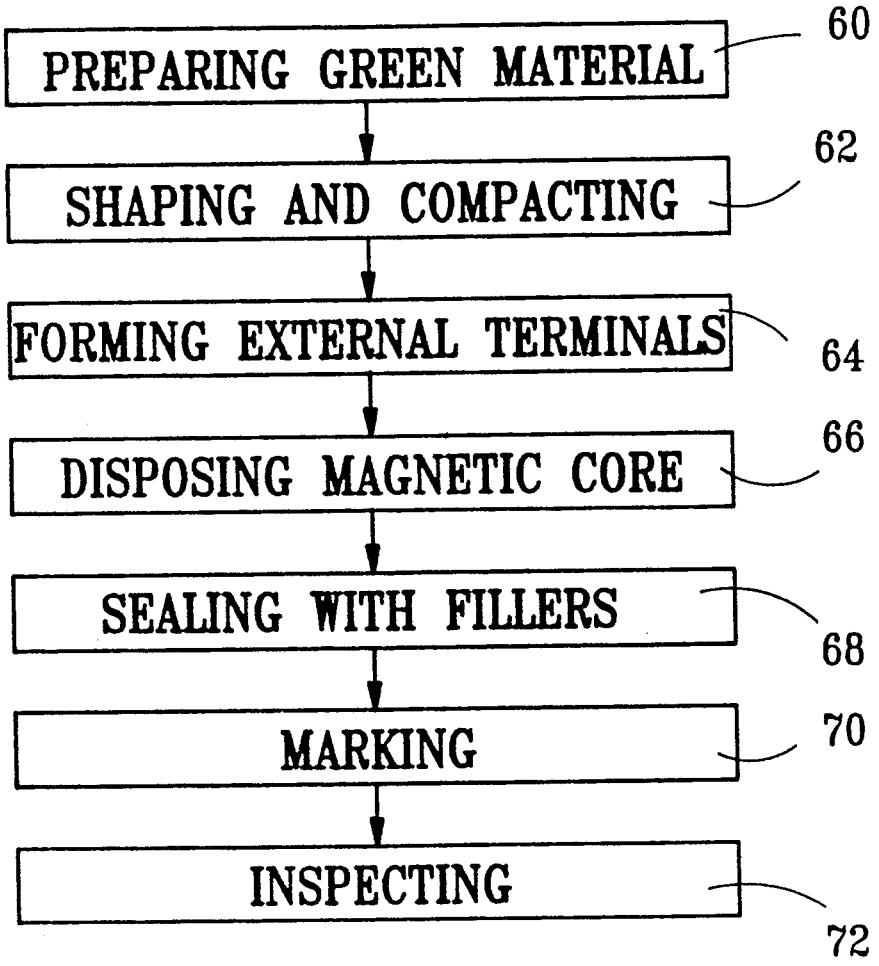
FIG. 2 is a ceramic chip inductor manufacturing process in accordance with the present invention.

Further referring to FIG. 2 wherein the manufacturing process of the ceramic chip inductor 10 is shown, the appropriate ceramic powder or powders is first bonded to form particles of a desirable size which helps conveying the green material in the manufacturing process. This is shown in 60 of FIG. 2. The ceramic particles are then at step 62 shaped and compacted to form the desired shape, such as a parallelepiped 20 with a central bore 21 and then sintered at, for example, 1,300 to 1,500 degrees Celsius, which is the same as the conventional powder metallurgy procedures. At step 64, the external terminals 40 are formed. Meanwhile, the naked chip inductor 30 is manufactured with the conventional techniques. Thereafter, at step 66, the naked chip inductor 30 is inserted into the central bore 21 of the parallelepiped 20 and the wire 32 wound thereon is soldered to the external terminals 40. The central bore 21 is then sealed with resin filler 50 at step 68. The ceramic chip inductor 10 is then marked at step 70 and inspected at step 72. This completes the manufacturing process of the ceramic chip inductors in accordance with the present invention.

It should be noted that the powder metallurgy techniques and the naked chip inductor manufacturing techniques are conventional and familiar to those skilled in the art. However, the novelty of the present invention resides in that the method in accordance with the present invention significantly simplifies the manufacturing process of the chip inductors and thus providing higher manufacturing efficiency and lower manufacturing cost. The chip inductors so manufactured has a stable physical property as compared with the products of the conventional methods so that the manufacturing cost can be further lowered. This is apparent from the following comparison tables, in which Table 1 is a list of the property of 25 samples of the ceramic chip inductor manufactured in accordance with the present invention, Table 2 is a list of 25 samples of the prior art epoxy chip inductors and Table 3 is a summary and comparison of these ceramic chip inductors and the epoxy chip inductors.

TABLE 1 property of ceramic chip inductors
product reference: CI453232S-150K
wire: 0.06ϕ UEW, 38 turns

| No | $L_b$ (μH) | $Q_b$ | $L_a$ (μH) | $Q_a$ | SRF | RDC | IDC |
|---|---|---|---|---|---|---|---|
| 1. | 14.76 | 81 | 14.59 | 67 | 27.5 | 1.263 | 828 |
| 2. | 15.06 | 85 | 14.58 | 64 | 26.1 | 1.263 | 828 |
| 3. | 14.93 | 90 | 14.69 | 68 | 25.6 | 1.265 | 835 |
| 4. | 15.02 | 80 | 14.72 | 63 | 27.1 | 1.259 | 830 |
| 5. | 14.84 | 88 | 14.78 | 65 | 26.2 | 1.265 | 795 |
| 6. | 14.66 | 85 | 14.32 | 62 | 24.7 | 1.231 | 800 |
| 7. | 14.78 | 90 | 14.67 | 70 | 25.5 | 1.285 | 825 |
| 8. | 14.69 | 86 | 14.52 | 67 | 26.2 | 1.232 | 823 |
| 9. | 15.00 | 86 | 14.65 | 67 | 26.2 | 1.282 | 805 |
| 10. | 14.95 | 90 | 14.72 | 69 | 26.8 | 1.264 | 812 |
| 11. | 14.55 | 83 | 14.74 | 63 | 25.8 | 1.225 | 798 |
| 12. | 15.02 | 90 | 14.34 | 66 | 24.8 | 1.265 | 793 |
| 13. | 15.14 | 92 | 14.73 | 66 | 25.9 | 1.302 | 794 |
| 14. | 14.86 | 85 | 14.85 | 72 | 26.1 | 1.298 | 798 |
| 15. | 14.77 | 87 | 14.36 | 62 | 26.5 | 1.240 | 773 |
| 16. | 15.18 | 88 | 14.56 | 71 | 27.1 | 1.242 | 800 |
| 17. | 14.53 | 88 | 14.72 | 67 | 27.0 | 1.269 | 786 |
| 18. | 14.75 | 80 | 14.23 | 62 | 25.8 | 1.242 | 822 |
| 19. | 15.11 | 86 | 14.14 | 60 | 25.1 | 1.251 | 843 |
| 20. | 15.00 | 90 | 14.71 | 69 | 26.4 | 1.283 | 810 |
| 21. | 14.94 | 91 | 14.68 | 67 | 27.5 | 1.255 | 777 |
| 22. | 14.88 | 90 | 14.64 | 69 | 26.0 | 1.244 | 830 |
| 23. | 14.93 | 94 | 14.50 | 68 | 25.8 | 1.270 | 785 |
| 24. | 15.24 | 85 | 14.23 | 61 | 27.3 | 1.228 | 800 |

TABLE 1-continued property of ceramic chip inductors
product reference: CI453232S-150K
wire: 0.06ϕ UEW, 38 turns

| No | $L_b$ (μH) | $Q_b$ | $L_a$ (μH) | $Q_a$ | SRF | RDC | IDC |
|---|---|---|---|---|---|---|---|
| 25. | 14.57 | 88 | 14.53 | 69 | 27.0 | 1.269 | 792 |
| average | 14.488 | 87.1 | 14.563 | 65.9 | 25.23 | 1.2606 | 806.1 |

In the table, $L_b$ and $L_a$ respectively represent inductances before and after the chip inductor is enclosed in the ceramic enclosure of which the measuring unit is μH, $Q_b$ and $Q_a$ are quality factors before and after the enclosing procedure, SRF stands for self resonance frequency, RDC stands for DC resistance and IDC denotes DC current.

TABLE 2 property of epoxy chip inductors
product reference: NL453232S-150K
wire: 0.06ϕ UEW, 42 turns

| No | $L_b$ (μH) | $Q_b$ | $L_a$ (μH) | $Q_a$ | SRF | RDC | IDC |
|---|---|---|---|---|---|---|---|
| 1. | 17.47 | 86 | 14.27 | 60 | 22.2 | 1.361 | 311 |
| 2. | 16.95 | 86 | 14.02 | 59 | 21.9 | 1.314 | 305 |
| 3. | 17.30 | 80 | 14.37 | 62 | 23.0 | 1.302 | 306 |
| 4. | 17.62 | 88 | 14.51 | 62 | 21.9 | 1.342 | 304 |
| 5. | 17.90 | 82 | 14.47 | 66 | 21.3 | 1.328 | 292 |
| 6. | 17.29 | 77 | 14.55 | 62 | 23.5 | 1.340 | 317 |
| 7. | 17.41 | 81 | 14.29 | 59 | 22.0 | 1.339 | 296 |
| 8. | 18.08 | 74 | 14.61 | 65 | 24.5 | 1.319 | 303 |
| 9. | 17.39 | 77 | 15.05 | 65 | 22.6 | 1.338 | 284 |
| 10. | 17.67 | 86 | 14.82 | 64 | 22.4 | 1.341 | 319 |
| 11. | 17.74 | 85 | 14.17 | 65 | 24.1 | 1.371 | 295 |
| 12. | 17.99 | 75 | 14.81 | 64 | 21.9 | 1.307 | 306 |
| 13. | 17.68 | 84 | 14.35 | 58 | 21.7 | 1.341 | 315 |
| 14. | 18.07 | 82 | 14.90 | 61 | 22.0 | 1.380 | 319 |
| 15. | 17.72 | 83 | 14.07 | 55 | 22.1 | 1.319 | 319 |
| 16. | 17.32 | 82 | 15.07 | 64 | 22.8 | 1.327 | 310 |
| 17. | 18.12 | 86 | 14.27 | 61 | 22.9 | 1.376 | 321 |
| 18. | 17.52 | 83 | — | — | — | — | — |
| 19. | 17.56 | 82 | — | — | — | — | — |
| 20. | 17.68 | 80 | — | — | — | — | — |
| 21. | 17.49 | 79 | — | — | — | — | — |
| 22. | 17.36 | 86 | — | — | — | — | — |
| 23. | 17.32 | 85 | — | — | — | — | — |
| 24. | 17.66 | 83 | — | — | — | — | — |
| 25. | 17.37 | 80 | — | — | — | — | — |
| average | 17.589 | 82.0 | 14.506 | 61.8 | 22.50 | 1.3794 | 307.1 |

In the table, $L_b$ and $L_a$ respectively represent inductances before and after the chip inductor is enclosed and shielded with epoxy material and the measuring unit is μH, $Q_b$ and $Q_a$ are quality factors before and after the epoxy modeling injection procedure, SRF stands for self resonance frequency, RDC stands for DC resistance and IDC denotes DC current. It can be calculated from the average value listed in the last row of Table 2 that the inductance reduces about 17.5% after the modeling injection procedure and the quality factor reduces approximately 24.6%. This is due to the silicon contained in the epoxy resin use to shield the magnetic core.

TABLE 3 comparison of the present invention with the prior art

| manufacturing process | ceramic chip inductor CI453232S-150K | epoxy chip inductor NL453232S-150K |
|---|---|---|
| material: | | |
| core | CI4.5X3.2X3.2 | |
| | $D_2$DR 2.2X4.2 | $D_2$DR 2.2X4.2 |
| wire | 0.06ϕ UEW | 0.05ϕ UEW |
| turns | 38 | 42 |
| property: | | |
| $L_b$ | 14.488 μH | 17.578 μH |

TABLE 3-continued

| comparison of the present invention with the prior art | | |
|---|---|---|
| $Q_b$ | 87.1 | 82.0 |
| $L_a$ | 14.568 μH | 14.506 μH |
| $Q_a$ | 65.9 | 61.8 |
| SFR | 26.23 | 22.51 |
| RDC | 1.2606 | 1.3794 |
| IDC | 806.1 | 307.1 |

It is concluded from the Tables that the manufacturing process in accordance with the present invention provides chip inductors having only limited variation in property during manufacture so that it is easy to handle in manufacturing, while the prior art manufacturing method provides products having great variation in property during manufacture. Due to the deterioration of property (see Table 2) which is because of the silicon contained in the epoxy resin, the conventional chip inductors have to have more turns of winding wire to compensate the deterioration and thus increasing cost.

Although the invention has been described with reference to the preferred embodiment, those skilled in the art will recognize that changes may be made in form and detail without departing from the spirit and scope of the invention as defined in the appended claims.

What is claimed is:

1. A method for manufacturing a chip inductor with a ceramic shield, wherein said chip inductor, has a core made of magnetic material with an electrically conductive wire wound thereon, comprising:

providing a ceramic body with a central bore formed therein;

forming external terminals on said ceramic body, each of said external terminals being made of a plurality of layers of different metals and/or alloys thereof;

disposing said magnetic core, along with the electrically conductive wire, into the central bore of said ceramic body;

soldering said electrically conductive wire to said external terminals; and sealing said bore of the ceramic body with a plurality of insulating fillers, wherein said magnetic core and the electrically conductive wire are enclosed inside the central bore.

2. A method as claimed in claim 1 further comprising a step of marking said chip inductor and a step of inspecting said chip inductor.

3. A method as claimed in claim 1 wherein said ceramic body is made of kaoline with powder metallurgy techniques.

4. A method as claimed in claim 1 wherein each of said external terminals is made of three layers of different metals and/or alloys.

5. A method as claimed in claim 4 wherein said three layers comprises one layer of silver, one layer of nickel and one layer of the alloy of tin and lead.

6. A method as claimed in claim 1 wherein said insulating fillers are made of resin.

7. A method as claimed in claim 6 wherein said resin is epoxy resin.

8. A method as claimed in claim 6 wherein said resin is acrylic resin.

* * * * *

UNITED STATES PATENT AND TRADEMARK OFFICE

CERTIFICATE OF CORRECTION

PATENT NO. : 5,307,557

DATED : May 3, 1994

INVENTOR(S) : Te-Hsueh Tseng

It is certified that error appears in the above-indentified patent and that said Letters Patent is hereby corrected as shown below:

On the title page, Item [75] Inventor: should read --Te-Hsueh, Hsin-Chu Hsien, Taiwan--.

Signed and Sealed this

Second Day of August, 1994

*Attest:*

Bruce Lehman

BRUCE LEHMAN

*Attesting Officer*

*Commissioner of Patents and Trademarks*